United States Patent [19]

Riehl

[11] 4,298,336

[45] Nov. 3, 1981

[54] PILOT BURNER IGNITION MEANS AND METHOD OF MAKING THE SAME

[75] Inventor: Fred Riehl, Greensburg, Pa.

[73] Assignee: Robertshaw Controls Company, Richmond, Va.

[21] Appl. No.: 73,673

[22] Filed: Sep. 10, 1979

[51] Int. Cl.[3] ..... F23Q 3/00

[52] U.S. Cl. ..... 431/264; 431/266

[58] Field of Search ..... 431/266, 265, 264, 258, 431/259, 42

[56] References Cited

U.S. PATENT DOCUMENTS

| | | | |
|---|---|---|---|
| 2,545,945 | 3/1951 | Ensign et al. | 431/266 |
| 2,667,920 | 2/1954 | Smith | 431/266 |
| 2,976,919 | 3/1961 | Sanborn | 431/265 |
| 3,308,871 | 3/1967 | Riehl | 431/42 |
| 3,511,588 | 5/1970 | Wolfe et al. | 431/264 |
| 3,938,946 | 2/1976 | Phlaum | 431/264 |
| 4,177,034 | 12/1979 | Jones | 431/264 |

*Primary Examiner*—James C. Yeung

*Attorney, Agent, or Firm*—Candor, Candor & Tassone

[57] ABSTRACT

A combination of a pilot burner for issuing fuel out of an outlet thereof and being supplied thereto from a source of the fuel and an electrical probe having an end spaced from the outlet of the pilot burner to provide a spark gap therewith and through which an electrical sparking is adapted to take place to ignite the issuing fuel when the probe is interconnected to a source of electrical energy and the fuel is issuing from the outlet, the end of the probe being disposed beneath the outlet of the pilot burner and defining the spark gap with a diffusion tang of the pilot burner that is disposed adjacent the outlet thereof.

12 Claims, 10 Drawing Figures

PILOT BURNER IGNITION MEANS AND METHOD OF MAKING THE SAME

BACKGROUND OF THE INVENTION

1. Field of the Invention

This invention relates to an improved electrical ignition system for a pilot burner of a fuel burning apparatus, such as a cooking apparatus or the like, and to a method of making such an electrical ignition system.

2. Prior Art Statement

It is known to provide an ignition system for a pilot burner of a cooking apparatus wherein the pilot burner has means for issuing fuel out of an outlet means thereof and being supplied thereto from a source of said fuel and an electrical probe has an end spaced from the outlet means of the pilot burner to provide a spark gap therewith and through which an electrical sparking is adapted to take place to ignite the issuing fuel when the probe is interconnected to a source of electrical energy and the fuel is issuing from the outlet means.

The end of the probe is disposed above the outlet means of the pilot burner so that once a continuously burning flame is created at the outlet means of the pilot burner through the previous electrical sparking, the continuously burning pilot flame provides an ionization of the air between the grounded pilot burner and the end of the probe to continuously dissipate a capacitor which originally had the charge build up to cause the sparking from the probe end so that further sparking of the probe does not take place as long as the pilot flame exists. However, should the flame cease, the capacitor is then permitted to build up its charge in a manner to cause a resparking from the end of the probe to the grounded pilot burner to reignite the issuing fuel.

A similar arrangement is provided in the patent to Wolfe et al, U.S. Pat. No. 3,511,588 except that the ignition probe is interconnected to a piezoelectric crystal element means which when squeezed or impacted will provide a sparking potential. However, the probe end is disposed above the outlet of the pilot burner which directs its fuel vertically upwardly to be deflected by a flame shield toward the ignition probe, the ignition probe creating a spark gap with a diffusion tang at the free end of the flame shield.

It is also known to provide a pilot burner that creates a small stand-by pilot flame which will be increased to a large heater flame by a control device so that the large heater flame is sensed by a sensor of a safety valve means which only opens when such large flame exists at the pilot burner means and thereby permits a fuel flow to the main burner means that is ignited by the pilot burner means. Thus, as long as the large flame exists at the pilot burner means, fuel is permitted to flow to the main burner means, the large flame at the pilot burner means being under the control of a thermostatically operated control device that is set to the desired temperature that is to be maintained in a cooking oven or the like.

For example, see the following U.S. patent (1) U.S. patent to Riehl, U.S. Pat. No. 3,308,871

It is also known to provide an ignition electrode disposed beneath a main gas burner of an oven or the like.

For example, see the following U.S. patent:

(2) U.S. patent to Ensign et al, U.S. Pat. No. 2,545,945

It appears in FIG. 9 of Item (2) above, that an ignition electrode is disposed beneath a main gas burner.

SUMMARY OF THE INVENTION

It is a feature of this invention to provide an improved combination of a pilot burner means and an electrical ignition probe therefor.

In particular, it was found according to the teachings of this invention that when a certain pilot burner means was to have an electrical ignition probe provided with its end spaced above the outlet means to cooperate therewith to produce an ignition spark gap as in the prior known electrical ignition arrangement, the flow of fuel to such pilot burner means was insufficient to create a large enough stand-by flame to ionize the space between the pilot burner means and the end of the probe to dissipate the capacitor that caused the sparking from the probe end so that even though a pilot flame was provided, continuous sparking from the probe end resulted and thereby caused a more rapid deterioration of the ignition arrangement.

It was also found according to the teachings of this invention that if the supply of fuel to such pilot burner means was increased in order to provide a large enough stand-by flame that would provide sufficient ionization in the spark gap to prevent sparking once the pilot flame was created, the enlarged size of the stand-by pilot flame was sensed by the flame sensor of the safety valve means so that the safety valve means would open even though no large heater flame existed at the pilot burner means demanding that the safety valve be opened whereby a runaway temperature condition would exist in the oven containing such an arrangement.

However, it was found according to the teachings of this invention that if the probe end was disposed beneath the outlet means of such a pilot burner, a sufficient flame area would be created between the probe end and the outlet means of the pilot burner to sufficiently ionize the spark gap to dissipate the capacitor that supplies energy to the probe without requiring an increased flow of fuel to that pilot burner as would be the case if the probe end was disposed above the outlet means as in the prior known electrical ignition system.

For example, one embodiment of this invention provides a combination of a pilot burner having means for issuing fuel out of an outlet means thereof and being supplied thereto from a source of the fuel and an electrical probe having an end spaced from the outlet means of the pilot burner to provide a spark gap therewith and through which an electrical sparking is adapted to take place to ignite the issuing fuel when the probe is interconnected to a source of electrical energy and the fuel is issuing from the outlet means, the end of the probe being disposed beneath the outlet means and defining the spark gap with a diffusion tang of the pilot burner that is disposed adjacent the outlet means thereof. The tang has a free end disposed in the path of the fuel issuing from the outlet means. The end of the probe defines the spark gap with the free end of the tang, the free end of the tang and the end of the probe being disposed in substantially vertically aligned relation. The pilot burner is disposed substantially horizontal so that the fuel issues substantially horizontally out of the outlet means until it impinges against the tang. The probe is disposed substantially horizontal in spaced parallel relation to the pilot burner. The end of the probe is bent at substantially a right angle to the probe and extends substantially vertically upwardly toward the free end of the tang. The tang is bent at substantially a right angle to the pilot burner and extends substantially vertically downwardly toward the end of the probe.

Accordingly, it is an object of this invention to provide an improved combination of a pilot burner and an electrical ignition probe therefor, the combination of this invention having one or more of the novel features of this invention as set forth above or hereinafter shown or described.

Another object of this invention is to provide a method of making such a combination, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
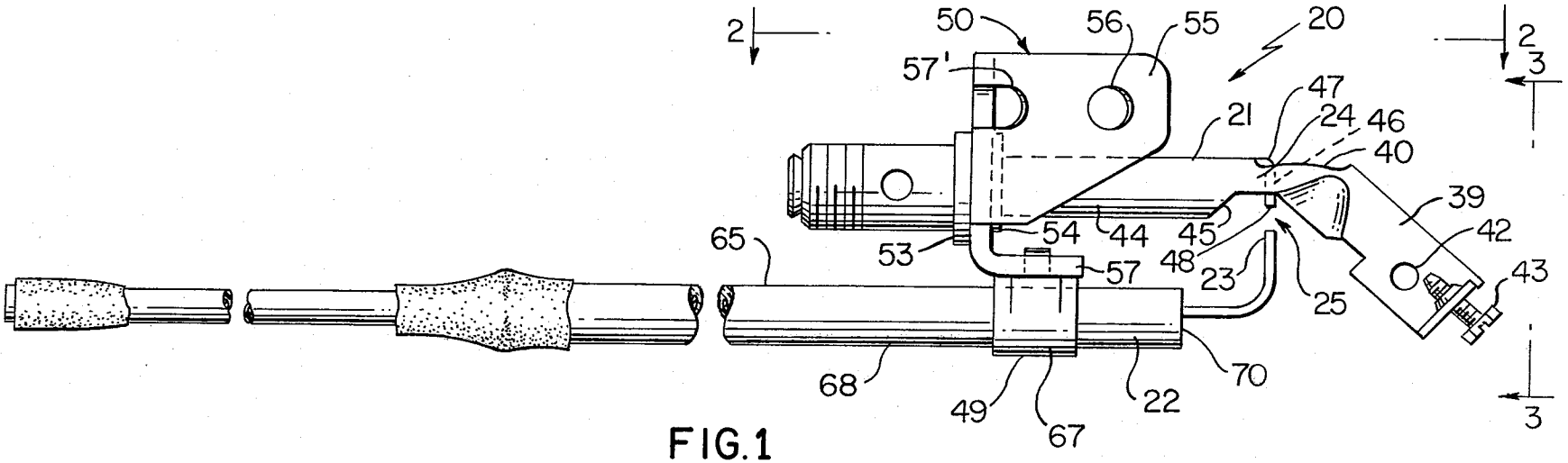
FIG. 1 is a side view of the improved pilot burner and electrical ignition probe arrangement of this invention.
Figure 2:
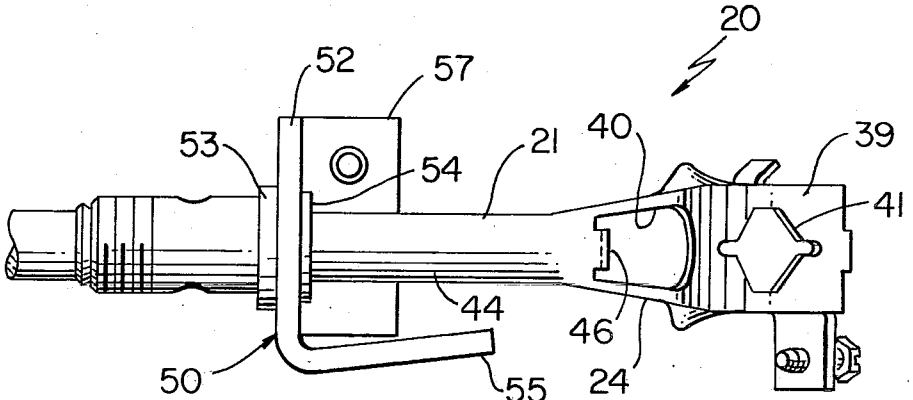
FIG. 2 is a fragmentary top view of the arrangement illustrated in FIG. 1 and is taken in the direction of the arrows 2—2 of FIG. 1.
Figure 3:
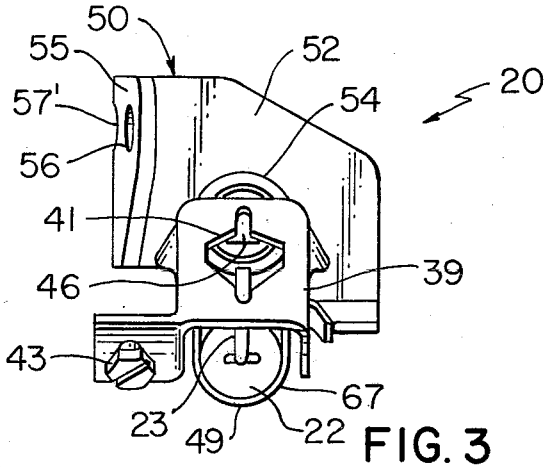
FIG. 3 is an end view of the arrangement illustrated in FIG. 1 and is taken in the direction of the arrows 3—3 of FIG. 1.
Figure 6:
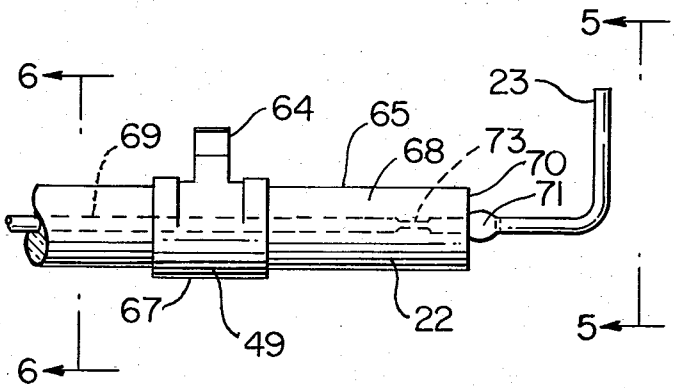
FIG. 6 is a cross-sectional view taken on line 6—6 of FIG. 4.
Figure 6:
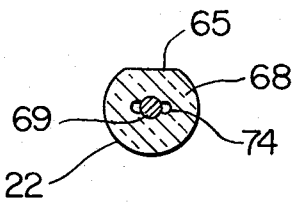

Referring now to FIGS. 1, 2 and 3, the improved electrical ignition arrangement of this invention is generally indicated by the reference numeral 20 and comprises the combination of a pilot burner 21 and an electrical probe 22 having an end 23 that cooperates with an outlet means 24 of the pilot burner 21 to define a spark gap 25 therewith and through which electrical sparking can take place to ignite fuel issuing out of the outlet means 24 and being supplied thereto from a suitable source of gaseous fuel.

Figure 10:
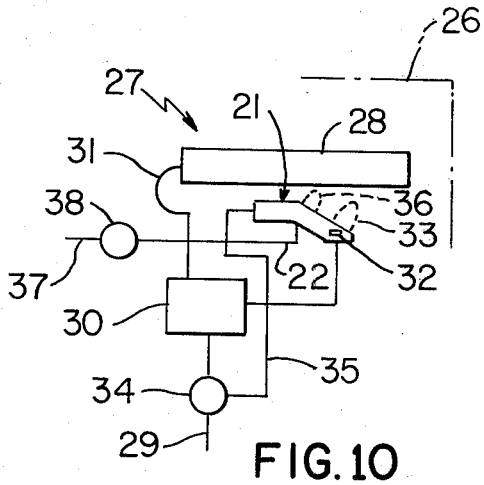
FIG. 10 is a schematic view illustrating the electrical and burner control system utilizing the probe and pilot burner arrangement of FIG. 1.
Figure 7:
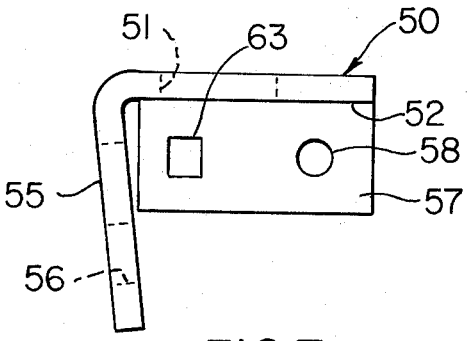
FIG. 7 is a top view of the mounting bracket of the arrangement of FIG. 1.
Figure 8:
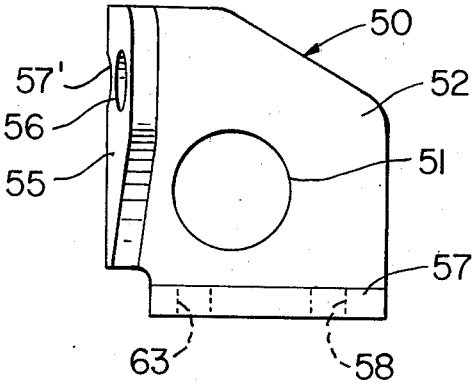
FIG. 8 is an end view of the bracket of FIG. 7.

For example, reference is now made to FIG. 10, wherein a fuel control system for an oven means 26 of a cooking apparatus (not shown) is generally indicated by the reference numeral 27 and comprises a main burner means 28 having the pilot burner means 21 for igniting fuel issuing therefrom in a manner well known in the art.

For example, see the aforementioned patent to Riehl, U.S. Pat. No. 3,308,871 which discloses a pilot burner means and fuel control system similar to the system 27 illustrated in FIG. 10 except that the same does not have the electrical ignition probe 22 of this invention. However, such patent is incorporated by reference into this application for a showing of the details and a description of the operation of the fuel control system 27.

Fuel is directed to the main burner 28 of the system 27 from a fuel source conduit 29 through a safety valve device 30 that will only interconnect the fuel source conduit 29 to the burner inlet conduit 31 when a flame sensor 32 senses the presence of a large heater flame 33 at the pilot burner 21. Fuel is also supplied from the fuel source conduit 29 by a thermostatically operated control device 34 to the pilot burner inlet conduit 35 in the manner set forth in the aforementioned patent to Riehl, U.S. Pat. No. 3,308,871 so that when the control device 34 is in an "on" condition thereof, sufficient fuel is directed from the fuel source conduit 29 to the pilot conduit 35 to create a small continuously burning stand-by flame 36 which will be subsequently increased in size to create the large heater flame 33 when the thermostatic device 34 determines that the output temperature effect in the oven 26 has fallen below the output temperature setting of the control device 34. Conversely, when the output temperature effect of the burner means 28 in the oven 26 is above the selected setting of the control device 34, the control device 34 reduces the flow of fuel to the pilot burner 21 so that the same will only maintain the small stand-by flame 36 whereby the safety valve 30 will close and thereby prevent further fuel from issuing from the main burner 28 until a large heater flame 33 is again created by the pilot burner 21.

In this manner, the main burner means 28 is cycled on and off by the pilot burner 21 under the control of the control device 34 so as to tend to maintain an output temperature effect in the oven 26 that is determined by the temperature setting of the control device 34.

As previously stated, the electrical probe 22 is adapted to be supplied energy from an energy source 37 through suitable electrical control means 38 to cause sparking at the gap 25 to initially ignite the fuel issuing from the outlet means 24 of the pilot burner means 21 to create the small stand-by flame 36 when the control device 34 is initially turned from an "off" condition thereof to an "on" condition thereof.

However, once the small stand-by flame 36 is created at the pilot burner means 21, the stand-by flame 36 causes suitable ionization to take place in the air gap 25 to dissipate any build-up of electrical current in a spark creating capacitor of the control means 38 so that further sparking between the probe end 23 and the outlet means 24 of the pilot burner 21 will not take place as long as a flame exists at the outlet means 24, whether the flame is the small stand-by flame 36 or the large heater flame 33.

The prior known control means 38 and its operation does not form part of this invention as this invention is directed to the unique arrangement of the electrical probe 22 beneath the outlet means 24 of the pilot burner means 21 for the purpose previously described whereas the prior known electrical probes are disposed above the outlet means 24.

As illustrated in FIGS. 1–3, the outlet means 24 of the pilot burner 21 includes a flame shield 39 which is provided with a first opening 40 through which the small stand-by flame 36 can issue. The flame shield 39 has another opening 41 spaced below the first opening 40 and through which the large heater flame 33 can issue, the flame shield 39 having a suitable mounting opening 42 to receive the flame sensor 32 to be secured therein by a suitable fastening member 43 in a manner well known in the art.

The main body 44 of the pilot burner 21 comprises a stepped tubular means having an open end 45 and out of which the fuel issues to impinge against a downwardly bent diffusion tang 46 so as to create a turbulant flow of fuel to thoroughly mix with secondary air to create the flame means 36 or 33 as previously described, the diffusion tang 46 having its upper end 47 integrally formed with the flame shield 39 and being carved therefrom when the opening 40 is formed whereby the lower free end 48 of the diffusion tang 46 is directed substantially vertically downwardly as illustrated in FIG. 1.

It was found according to the teachings of this invention that if the probe end 23 of the electrical probe 22 is bent at substantially a right angle so as to be directed substantially vertically upwardly into aligned relation with the free end 48 of the diffusion tang 46, the free end 48 of the diffusion tang 46 will create the desired spark gap 25 with the end 23 of the electrical probe 22 in such a manner that the resulting flame in the spark gap area 25 will be sufficient to ionize the air between the probe end 23 and the free end 48 of the diffusion tang 46 to permit complete dissipation of any electrical charge on the probe 22 after the flame 33 has been created without requiring an increased flow of fuel to the pilot burner 22 as would be the case if the probe 22 were mounted above the outlet means 24 as in the prior know electrical ignition arrangements.

In order to secure the electrical probe 22 beneath the outlet means 24 of the pilot burner 21 in a proper relation to the diffusion tang 46 of the pilot burner 21, a clip 49 is utilized to fasten the probe 22 to a mounting bracket 50 of the pilot burner 21.

In particular, the mounting bracket 50 has an opening 51 in a flange 52 thereof and through which the main body 44 of the pilot burner 21 is inserted and fastened by the fastening members 53 and 54 being disposed on opposite sides of the flange 52 in a manner well known in the art.

Another fange 55 of the mounting bracket 50 is provided with suitable opening means 56 and 57 for fastening to suitable structure in the oven means 26 so that the pilot burner 21 will be mounted in the proper position relative to the main burner 28 in a manner well known in the art.

A lower flange 57 of the mounting bracket 50 is disposed substantially horizontally and has an opening 58 therethrough which is adapted to receive a threaded fastening member 59 that passes through suitable opening means 60 in a pair of legs 61 and 62 of the clip 49 to fasten the clip 49 directly to the flange 57 of the mounting bracket 50. In addition, the flange 57 of the mounting bracket 50 has another opening 63 which is adapted to receive an upstanding tang 64 of the clip 49 so as to prevent rotational movement of the clip 49 relative to the mounting bracket 50 whereby a proper orientation of the clip 49 relative to the mounting bracket 50 is assured.

In order to orient the probe 22 in the clip 49 so that the end 23 thereof will be disposed substantially vertically upwardly to cooperate with the diffusion tang 46 of the pilot burner 21, the probe 22 has a substantially flat section 65 adapted to cooperate with a flat section 66 of the leg 61 of the clip 49 so that rotational movement of the probe 22 in the clip 49 cannot take place, the legs 61 and 62 being integrally interconnected to a substantially annular portion 67 of the clip 49 that encompasses the probe 22 to be compressed/squeezed against the probe 22 when the legs 61 and 62 are compacted together in a superimposed relation by the fastening member 59.

Figure 4:
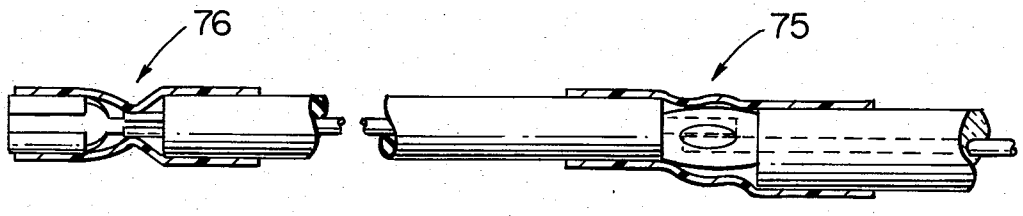
FIG. 4 is a fragmentary view similar to FIG. 1 and illustrates the electrical probe with parts thereof shown broken away or in cross section.
Figure 5:
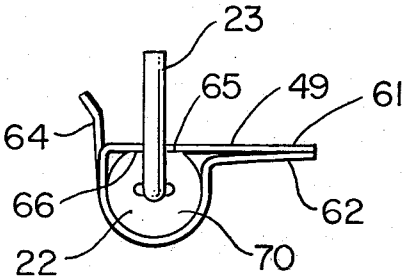
FIG. 5 is an end view of the electrical probe of FIG. 4 and is taken in the direction of the arrows 5—5 of FIG. 4.
Figure 9:
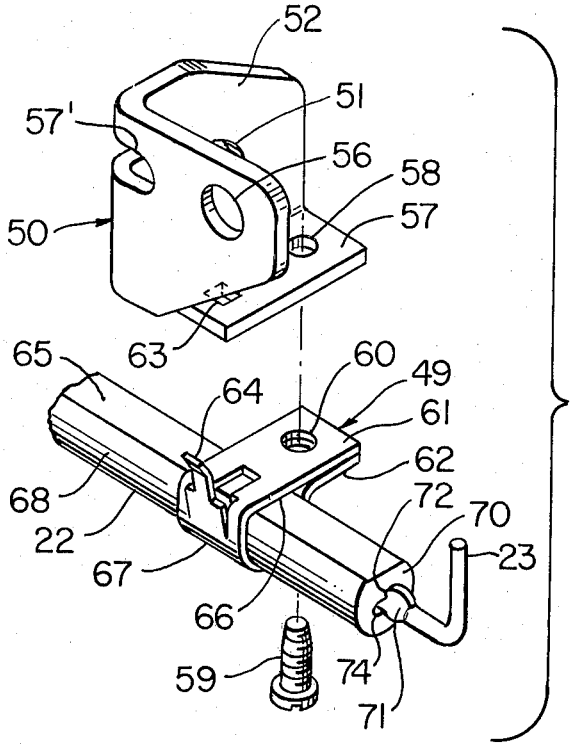
FIG. 9 is a fragmentary exploded perspective view of the bracket and clip means for securing the probe to the mounting bracket.

The electrical probe 22 can comprise an electrically insulating part 68 of ceramic material or the like and carrying an electrical conductor 69 therethrough, the conductor 69 extending out of the end 70 of the insulating member 68 so as to provide the bent probe end 23 previously described. In order to prevent rotation of the electrical conductor 69 in the insulating member 68, a suitable flattened section 71 of the probe end 23 can be disposed in a substantially vertical slot 72, FIG. 9, formed in the end 70 of the insulating member 68 while another horizonally disposed flattened section 73 of the conductor 69 within the insulating member 68 is disposed in another slotted portion 74 of the insulating member 68 as illustrated in FIG. 4.

Of course, suitable splicing sections 75 can be utilized and a terminal end section 76 can be utilized to interconnect the probe 22 to the control means 38.

Therefore, it can be seen that the electrical ignition arrangement of this invention can be formed from a relatively few parts in a relatively simple manner by the method of this invention to operate in a manner now to be described.

With the probe 22 mounted beneath the outlet means 24 of the pilot burner 21 and being suitably interconnected to the electrical energy source 37 while the pilot burner 21 is interconnected to the fuel source 29, the charge built up on the electrical probe 22 causes electrical sparks in the spark gap 25 between the end 23 of the probe 22 and the free end 48 of the diffusion tang 46 of the grounded pilot burner 21 so that such sparking ignites the fuel issuing from the open end 45 of the pilot burner 21 to create the small stand-by flame 36. The flame 36 sufficiently ionizes the air in the gap 25 so that any electrical charge built up on the probe end 23 is immediately dissipated to the grounded pilot burner 21 at the free end 48 of the diffusion tang 46 so that the capacitor in the control means 38 will not build up a sufficient charge to cause continuous sparking across the gap 25 as long as the small stand-by flame 36 or the large heater flame 33 is in existence.

However, when the operator turns the control device 34 to the "off" condition thereof, not only is the fuel source 28 disconnected from the pilot burner 21, but also the electrical energy source 37 is disconnected from the probe 22 so that fuel does not issue from the pilot burner means 21 nor is sparking created at the gap 25 at this time.

During the operation of the pilot burner 21, should the flame 36 existing at the pilot burner means 21 and having been initially ignited in the manner previously described while the control device 34 continues to supply fuel to the pilot burner 21 go out for any reason, there will no longer be ionization of the air in the spark gap 25 so that a charge in the capacitor of the control means 38 will again build up to cause sparking across the gap 25 to again ignite the fuel issuing from the outlet means 24 of the pilot burner means 21 in the manner previously described.

Therefore, it can be seen that this invention not only provides an improved combination of a pilot burner means and an electrical ignition probe therefor, but also this invention provides an improved method of making such an arrangement.

While the form and method of this invention now preferred have been illustrated and described as required by the Patent Statute, it is to be understood that other forms and method steps can be utilized and still fall within the scope of the appended claims.

What is claimed is:

1. In a combination of a pilot burner having means for issuing fuel out of an outlet means thereof and being supplied thereto from a source of said fuel and an electrical probe having an end spaced from said outlet means of said pilot burner to provide a spark gap therewith and through which an electrical sparking is adapted to take place to ignite said issuing fuel when said probe is interconnected to a source of electrical energy and said fuel is issuing from said outlet means, the improvement wherein said end of said probe is disposed beneath said outlet means, said pilot burner having a diffusion tang adjacent said outlet means, said end of said probe defining said spark gap with said tang, said tang having a free end disposed in the path of the fuel issuing from said outlet means, said end of said probe defining said spark gap with said free end of said tang, said free end of said tang and said end of said probe being disposed in substantially vertically aligned relation, said pilot burner being disposed substantially horizontal so that said fuel issues substantially horizontally out of said outlet means until it impinges against said tang, said probe being disposed substantially horizontal in spaced parallel relation to said pilot burner, said end of said probe being bent at substantially a right angle to said probe and extending substantially vertically upwardly toward said free end of said tang, said tang being bent at substantially a right angle to said pilot burner and extending substantially vertically downwardly toward said end of said probe.

2. A combination as set forth in claim 1 wherein said pilot burner has a mounting bracket, said probe being carried by said mounting bracket.

3. A combination as set forth in claim 2 wherein said probe has a clip, said clip being fastened to said mounting bracket.

4. A combination as set forth in claim 3 wherein said clip has a pair of legs disposed in substantially superimposed parallel relation to each other, said clip having an annular portion joined to said legs and disposed about said probe, said legs being fastened to said mounting bracket.

5. A combination as set forth in claim 4 wherein said annular portion of said clip has an outwardly extending tang, said mounting bracket having an opening receiving said tang of said clip whereby said tang of said clip orients said probe relative to said pilot burner.

6. A combination as set forth in claim 5 wherein said probe has a substantially flat section, said annular portion of said clip having a substantially flat section cooperating with said flat section of said annular portion to orient said end of said probe relative to said pilot burner.

7. In a method of making a combination of a pilot burner having means for issuing fuel out of an outlet means thereof and being supplied thereto from a source of said fuel and an electrical probe having an end spaced from said outlet means of said pilot burner to provide a spark gap therewith and through which an electrical sparking is adapted to take place to ignite said issuing fuel when said probe is interconnected to a source of electrical energy and said fuel is issuing from said outlet means, the improvement comprising the steps of disposing said end of said probe beneath said outlet means, forming said pilot burner with a diffusion tang adjacent said outlet means, forming said end of said probe to define said spark gap with said tang, forming said tang with a free end that is disposed in the path of the fuel to be issuing from said outlet means, forming said end of said probe to define said spark gap with said free end of said tang, forming said free end of said tang and said end of said probe to be disposed in substantially vertically aligned relation, disposing said pilot burner to be substantially horizontal so that said fuel is adapted to issue substantially horizontally out of said outlet means until it impinges against said tang, disposing said probe to be substantially horizontal in spaced parallel relation to said pilot burner, forming said end of said probe to be bent at substantially a right angle to said probe and extend substantially vertically upwardly toward said free end of said tang, and forming said tang to be bent at substantially a right angle to said pilot burner and extending substantially vertically downwardly toward said end of said probe.

8. A method as set forth in claim 7 and including the steps of forming said pilot burner to have a mounting bracket, and securing said probe to said mounting bracket to be carried thereby.

9. A method as set forth in claim 8 and including the steps of forming said probe to have a clip, and fastening said clip to said mounting bracket.

10. A method as set forth in claim 9 and including the steps of forming said clip to have a pair of legs disposed in substantially superimposed parallel relation to each other, forming said clip to have an annular portion joined to said legs and disposed about said probe, and fastening said legs to said mounting bracket.

11. A method as set forth in claim 10 and including the steps of forming said annular portion of said clip to have an outwardly extending tang, and forming said mounting bracket to have an opening receiving said tang of said clip whereby said tang of said clip orients said probe relative to said pilot burner.

12. A method as set forth in claim 11 and including the steps of forming said probe to have a substantially flat section, and forming said annular portion of said clip to have a substantially flat section that cooperates with said flat section of said annular portion to orient said end of said probe relative to said pilot burner.

* * * * *